United States Patent [19]

Oya et al.

[11] 4,006,044

[45] Feb. 1, 1977

[54] STEEL SLAB CONTAINING SILICON FOR USE IN ELECTRICAL SHEET AND STRIP MANUFACTURED BY CONTINUOUS CASTING AND METHOD FOR MANUFACTURING THEREOF

[75] Inventors: Tatsuo Oya; Minoru Motoyoshi; Masfumi Okamoto; Kiyoshi Tanaka; Takayasu Sugiyama, all of Himeji, Japan

[73] Assignee: Nippon Steel Corporation, Tokyo, Japan

[22] Filed: Apr. 1, 1975

[21] Appl. No.: 563,980

Related U.S. Application Data

[63] Continuation-in-part of Ser. No. 501,818, Aug. 29, 1974, abandoned, which is a continuation of Ser. No. 253,850, May 16, 1972, abandoned.

[52] U.S. Cl. ..... 148/31.55; 75/49; 75/123 L; 148/110; 148/111; 148/112

[51] Int. Cl.[2] ..... C04B 35/00

[58] Field of Search ..... 148/111, 112, 110, 31.55; 75/123 L, 49

[56] References Cited

UNITED STATES PATENTS

| | | | |
|---|---|---|---|
| 3,163,564 | 12/1964 | Taguchi et al. | 148/111 |
| 3,214,303 | 10/1965 | Fiedler | 148/111 |
| 3,266,955 | 8/1966 | Taguchi et al. | 148/111 |
| 3,287,183 | 11/1966 | Taguchi et al. | 148/111 |
| 3,345,219 | 10/1967 | Detert | 148/112 |
| 3,522,114 | 7/1970 | Knuppel et al. | 148/111 |
| 3,632,456 | 1/1972 | Sakakura et al. | 148/111 |
| 3,764,406 | 10/1973 | Littmann | 148/111 |

*Primary Examiner*—Walter R. Satterfield
*Attorney, Agent, or Firm*—Toren, McGeady and Stanger

[57] ABSTRACT

A steel slab containing silicon for use as an electrical steel sheet and strip and having no blister occurrence in the final product manufactured by continuous casting, characterized in that said slab comprises 2.5 – 4.0 wt.% of silicon, less than 0.04% of aluminium, less than 3 ppm of hydrogen or less than 3 ppm of hydrogen together with less than 80 ppm of oxygen, and less than $[Al(\%) \times 10^3 + 50]$ ppm of nitrogen, with the remainder being essentially iron.

4 Claims, 3 Drawing Figures

STEEL SLAB CONTAINING SILICON FOR USE IN ELECTRICAL SHEET AND STRIP MANUFACTURED BY CONTINUOUS CASTING AND METHOD FOR MANUFACTURING THEREOF

CROSS REFERENCE TO RELATED APPLICATIONS

This application is a continuation-in-part of copending Application Ser. No. 501,818, filed on Aug. 29, 1974, and now abandoned, which, in turn, is a continuation of application Ser. No. 253,850, filed May 16, 1972 and now abandoned.

BACKGROUND OF THE INVENTION

1. Field of the Invention

This invention reltes to a steel slab containing silicon for use as an electrical steel sheet and strip manufactured by continuous casting and a method for manufacturing thereof.

2. Description of the Prior Art

In recent years, electrical steel sheets and strips have been manufactured by continuous casting, and the surface defects due to blisters in the final product have been a problem.

As used herein, blister means a puffy defect on the surface of the sheet and strip caused by the expansion of gases occluded in the steel in the heat treatment of the sheet and strip. Due to the occurrence of blisters, the commercial value of the electrical sheet and strip used as a material for laminated cores is almost lost.

While it is well known that low silicon- or non-silicon electrical steel sheets and strips have been utilized as electrical sheet and strips for cores of electrical instruments in recent years, high class materials represented by grain-oriented electrical sheet and strips contain silicon, which silicon content is generally in the range of 2.5 – 4%.

On the other hand, the material contains up to 1% of Al for improving the magnetic properties.

When the Al is less than 0.04% in a high class electrical sheet and strip containing 2.5 – 4% of Si, the surface defect called blisters occur frequently. It has been ascertained that the lower the Al content, the more frequently the blister occurs and that this frequently occurs in the continuous casting material.

While the reason of the occurrence of blister has mainly been regarded as due to hydrogen occluded in the steel, this was not the conclusion reached from our studies.

The frequent occurrence of blisters in the continuous casting material as above mentioned may also be considered to be due to the influence of mold lubricant (or thermal insulator) used in the continuous casting. However, no effect from the lubricant could be observed at all in our detailed experiments.

The object of this invention is to obtain, in the manufacture of electrical sheet and strips by continuous casting, a slab having no surface defects due to blisters in producing final products.

Another object of this invention is to offer a method for the continuous casting of molten steel containing silicon whose nitrogen or oxygen content has been controlled.

A further object of this invention is to offer a continuous casting slab for producing grain-oriented electrical steel sheets and strips wherein the occurrence of surface defect due to blister is minimized.

Still further objects of this invention may be seen from the description in this specification and the attached drawings.

BRIEF DESCCRIPTION OF THE DRAWINGS

SUMMARY OF THE INVENTION

Figure 1:
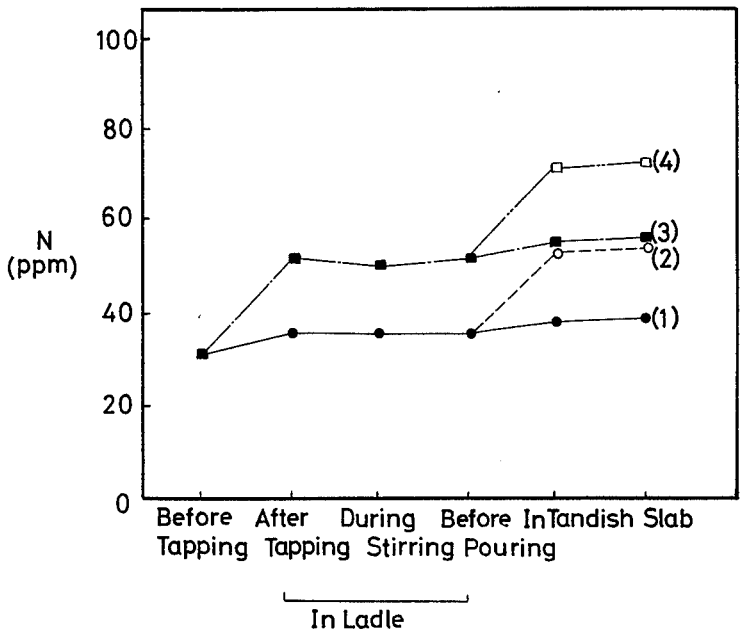
FIG. 1 is a graph showing the change of nitrogen content in the molten steel from the tapping to the pouring.

Applicants have discovered a method for producing a steel slab for use as cube-on-edge grain oriented electrical steel sheets and strips wherein the blister defect is minimized. Particularly, the present process comprises the continuous casting of a molten steel slab containing 2.5 – 4% of Si and less than 0.04% of Al, to cast continuously said molten steel in a condition so as to hold the hydrogen content within 3 ppm and the nitrogen content within $[Al(\%) \times 10^3 + 50]$ ppm, or further to hold the oxygen content within 80 ppm.

When the oxygen content is not restricted, the nitrogen content is preferably less than $[Al(\%) \times 10^3 + 40]$ ppm. However, the nitrogen content can be eased up to $[Al(\%) \times 10^3 + 50]$ ppm by defining the oxygen content to be less than 80 ppm. Thus, no formation of blisters occurs at all by easing the nitrogen content up to about 80 ppm even when the Al content is less than 0.01% and it becomes possible to consistently and uniformly manufacture electrical sheets and strips having no blisters by continuous casting particularly in the low Al region.

DESCRIPTION OF THE PREFERRED EMBODIMENTS

More particularly, the present invention relates to cube-on-edge grain oriented electrical steel sheets having excellent magnetic properties and high stability by continuously casting a steel slab containing 2.5 to 4.0 wt.% Si, less than 0.04 of Al, less than 3 ppm of hydrogen or less than 3 ppm of hydrogen together with less than 80 ppm of oxygen and less than $[Al(\%) \times 10^3 + 50]$ ppm of nitrogen with the remainder being iron. The slab is heated at a temperature not less than 1,200° C., and is then hot rolled, cold rolled with a reduction of not less than about 40%. It is then subjected to decarburization annealing and annealing at a temperature not lower than 1,100° C.

The silicon content is defined as 2.5 – 4% in this invention. This is because the invention aims at a high class electrical steel sheet and strip represented by grain-oriented electrical sheet and strip.

The Al content in said silicon steel is usually up to 1%. However, the Al content of a steel whose nitrogen content should be controlled strictly in order to prevent the occurrence of blisters is less than 0.04%, and therefore, the object of this invention relates to a steel containing less than 0.040% and preferably, less than about 0.010% of Al. Generally, the minimum amount of Al is about 0.002%.

As for other components, it is desirous that the steel comprises less than 0.060% of carbon, less than 0.40% of manganese, less than 0.03% of phosphorous and less than 0.03% of sulphur, with the remainder being iron and unavoidable impurities.

In order to prevent the occurrence of blisters in the final product, it is quite important to restrict the amount of hydrogen in the molten steel to less than 3 ppm while at the same time the steel is maintained under the condition that the nitrogen content is less than $[Al(\%) \times 10^3 + 50]$ ppm, preferably less than $[Al(\%) \times 10^3 + 40]$ ppm, or less than $[Al(\%) \times 10^3 + 50]$ ppm when the oxygen is restricted within 80 ppm. The object cannot be attained at all when only the hydrogen content is restricted as was previously thought.

The object cannot be attained also when merely nitrogen, or nitrogen and oxygen, are restricted. Only when the contents of hydrogen and nitrogen, or oxygen, satisfy the above mentioned condition, can the occurrence of blisters in the final product be prevented.

Usually, about 3 – 5 ppm of hydrogen is contained in the tapping of molten steel. To reduce the content to less than 3 ppm, the conventional vacuum degassing treatments may be applied.

On the other hand, the vacuum degassing treatment can be expected to have little effect on the nitrogen contrary to the case of hydrogen. To restrict the nitrogen content in the range of this invention, the nitrogen is reduced during the smelting in the steel making furnace by adjusting the amount of Al.

To prevent the pick-up of nitrogen from the tapping to the pouring, molten steel is protected by an inert atmosphere (in vacuum or inert gas). In some instances, when the amount of nitrogen is reduced satisfactorily during the smelting in the steel making furnace, there is no need to prevent the pick-up.

To reduce the oxygen content and to diminish oxide inclusions, the following methods may be applied: for instance, to reduce the amount of deoxidation product by lowering the oxygen content in the molten steel before deoxidation, to accelerate the floating-up of deoxidation products by elevating the temperature of the molten steel or by agitating the molten steel, to prevent the increase of oxygen (oxide inclusion) by the pick-up of atmospheric oxygen from the tapping (deoxidation) to the pouring, or a suitable combination of these methods.

As above mentioned, it is the essential point of this invention to restrict the final nitrogen content in the molten steel (slab) to be less than $[Al(\%) \times 10^3 + 50]$ ppm.

The reason why the nitrogen content is restricted in the range as above mentioned will be explained.

FIG. 1 shows an example of the change of nitrogen content from the tapping of molten steel to the pouring.

In FIG. 1, (1) shows the result when molten steel is subjected to alloy-addition by adding Si and Al during vacuum treatment, and said molten steel is sealed with argon gas from the ladle to the mold in the continuous casting; (2) shows the result when the molten steel in (1) is cast continuously without argon gas sealing; (3) is the case when molten steel is subjected to deoxidation and alloy-addition by adding Si and Al during tapping, and said molten steel is sealed with argon gas from the ladle to the mold in the continuous casting; and (4) is the case when the molten steel in (3) is cast continuously without argon gas sealing.

It is observed from FIG. 1 that the nitrogen in the steel has a tendency to increase significantly after the tapping. Therefore, the above mentioned methods are applied selectively according to the circumstances in order to restrict the nitrogen content in molten steel before tapping as well as in the molten steel (slab) in accordance with the Al content within the range of this invention.

Figure 2:
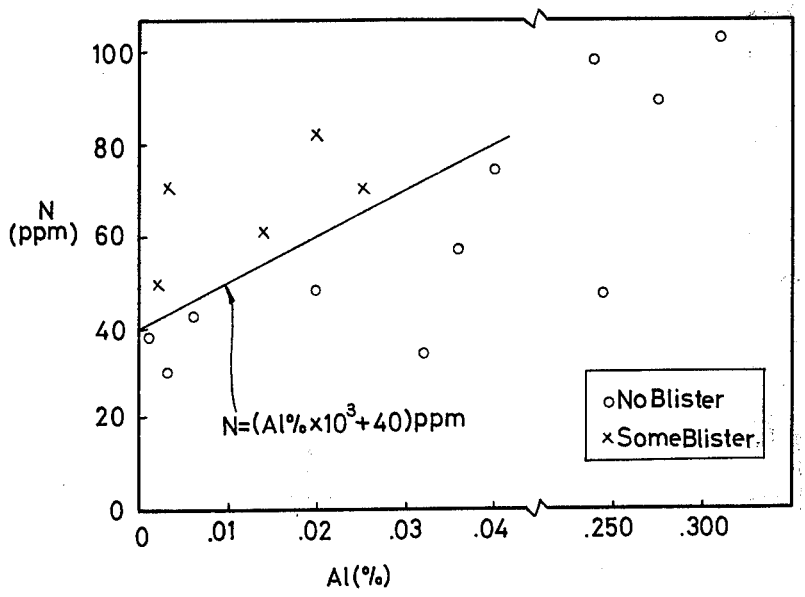
FIG. 2 is a graph showing the influence of the Al- and N contents on the occurrence of blisters in the final product.

FIG. 2 shows the occurrence of blisters in the final products which are prepared by cold rolling and annealing continuous casting materials having varying nitrogen and Al contents as usual after hot rolling. It is observed that nitrogen and Al have a distinct influence on the occurrence of blisters. When the Al content is large, the occurrence of blisters is controlled even if the nitrogen content is relatively large. However, as the Al content diminishes, the nitrogen content should be kept small. Thus, the inventive condition that the nitrogen content is less than $[Al(\%) \times 10^3 + 40]$ ppm is deduced.

Next, the influence of the oxygen content will be discussed.

The influence of oxygen content on the occurrence of blisters differs largely but should be kept under about 80 ppm.

When the oxygen content is more than about 80 ppm, the occurrence of blisters is accelerated. However, it is proved that less than about 80 ppm of oxygen has almost relation to the occurrence of blisters. It is possible that this may perhaps be due to the fact that oxide inclusions formed by the presence of oxygen segregates when the oxygen content increases, and the blisters occur by the accumulation of gaseous hydrogen and nitrogen at the site of segregation.

For instance, in a continuous cast silicon-steel strip containing Si 3.15%, Al 0.004%, N 0.0052%, O 0.0085% and H 0.0002%, the analyses of oxide inclusions were carried out at locations where blisters occurred and did not occur. The result is as shown in Table 1.

Table 1.

| | Analysis of oxide inclusion (wt. %) | | | | |
|---|---|---|---|---|---|
| location | $SiO_2$ | $Al_2O_3$ | MnO | CaO | O |
| blister occurred | 0.0169 | 0.0048 | 0.0008 | 0.0012 | 0.0118 |
| no blister | 0.0120 | 0.0042 | 0.0005 | 0.0006 | 0.0086 |

As is obvious from Table 1, a large amount of oxide inclusion is observed at the site where blisters occur.

Figure 3:
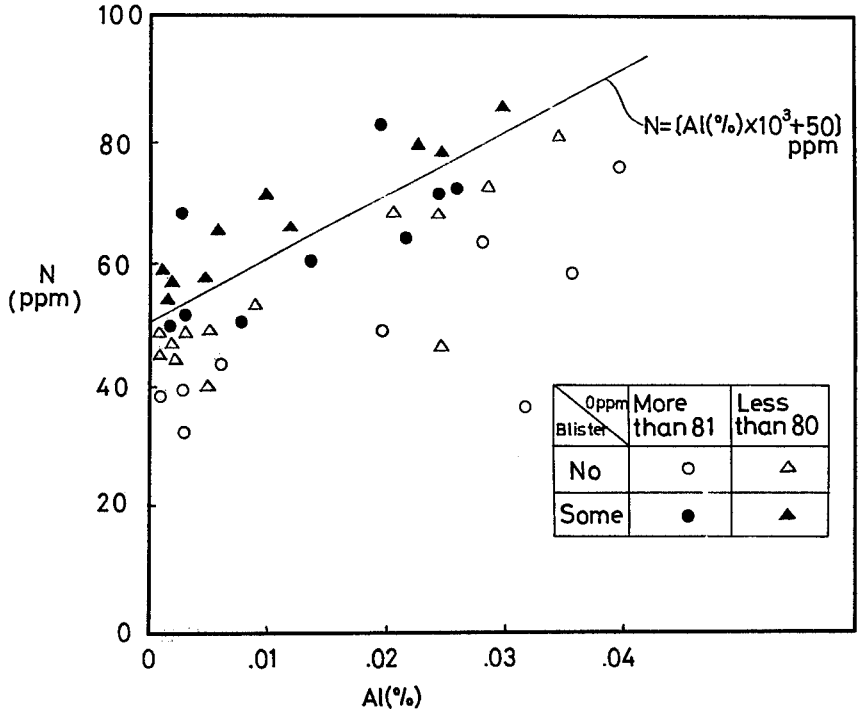
FIG. 3 is a graph showing the influence of the contents of Al, N and O on the occurrence of blisters in the final product.

FIG. 3 shows the effect of the nitrogen content on the occurrence of blisters when the oxygen content is greater and less than 80 ppm.

FIG. 3 shows the occurrence of blisters in final products which are prepared by cold rolling and annealing continuous cast materials having varying nitrogen, oxygen and Al contents after hot rolling. It is observed that nitrogen, oxygen, and Al have a distinct influence on the occurrence of blisters.

As the Al content diminishes, it is necessary to reduce the nitrogen content. However, by restricting the oxygen content within 80 ppm, the nitrogen content for controlling the occurrence of blisters can be raised higher than in the case when the oxygen content is not controlled.

Thus, it is concluded that the nitrogen content can be eased up to $[Al(\%) \times 10^3 + 50]$ ppm when the oxygen content is restricted within 80 ppm.

As above explained, the present invention is characterized in controlling the nitrogen content in connection with the contents of nitrogen, or hydrogen and oxygen, as well as Al in order to prevent the occurrence of blisters in the final product.

With respect to producing the slab defined herein, the slab is heated at a temperature not lower than about 1,200° C. It is then hot rolled, cold rolled with a reduction of not less than about 40% and subjected to decarburizaton annealing. Thereafter it is annealed at a temperature not less than about 1,100° C.

Preferably, the cold rolling is performed two or more times with an intermediate annealing step.

In order to produce a grain oriented electrical steel sheet having excellent magnetic properties with high stability, a slab heating temperature of not lower than about 1,200° C. is necessary, although the blister readily occurs in this temperature range in the conventional art.

The greater than about 40% cold rolling reduction is required for producing a grain oriented electrical steel sheet having excellent magnetic properties.

After the grains of a grain oriented electrical steel sheet is oriented by the secondary recrystallization, the annealing must be effected at a temperature not lower than 1,100° C. for removing the impurities, and since blister more readily occurs at higher temperatures.

Examples of this invention will be explained in the following.

In the following examples, the conditions used to prepare the slabs are summarized in Table 2 hereinbelow:

| | Example 1 | Example 2 | Example 3 | Example 4 |
|---|---|---|---|---|
| Heating Temperature for Slab Hot Rolling | 1300° C | 1320° C | 1300° C | 1300° C |
| Thickness of Hot Rolled Plate | 2.0 mm | 2.0 mm | 2.0 mm | 2.0 mm |
| Thickness after One Cold Rolling | 0.6 mm | 0.64 mm | 0.60 mm | 0.6 mm |
| Intermediate Annealing | 850° C × 2.5 min. | 850° C × 2.5 min. | 850° C × 2.5 min. | 850° C × 2.5 min. |
| Thickness after Final Cold Rolling | 0.3 mm | 0.3 mm | 0.3 mm | 0.3 mm |
| Decarburization Annealing | Wet hydrogen 800° C | same → | | |
| Final Annealing | 1150° C × 24 hr. | same → | | |

EXAMPLE 1

Necessary amounts of Si and Al were added when molten steel was tapped from a 100-ton converter to a ladle. Thus, the deoxidation and alloy-addition was carried out at the tapping. Then, said molten steel was degassed in a vacuum and cast continuously. In the continuous casting, a first half of the casting, about 50 tons, was sealed with argon gas from the ladle to the tandish and from the tandish to the mold, and a latter half, about 50 tons, was cast for comparison without argon gas sealing. The analysis of the slab obtained was: C 0.035%, Si 3.15%, Mn 0.05%, P 0.010%, Al 0.024% and H 1.5 ppm. Said slabs were hot rolled to an intermediate thickness, and treated by a conventional two-stage cold rolling method to obtain grain-oriented electrical strips with a thickness of 0.30 mm. The change of nitrogen content from molten steel to slab of the said test materials and the occurrence of blisters in the final products were as shown in Table 3 hereinbelow:

Table 3

| nitrogen content ppm | | | | occurrence of blister in final product* |
|---|---|---|---|---|
| before tapping | in ladle | slab | sealing from ladle to mold | |
| 35 | 56 | 58 | argon sealing | 0% |
| | | 75 (comparison) | no | 5.4% |

*The degree of the occurrence of blisters in the table is expressed by the ratio of the length of blistered part to the total length of product.

As is obvious from Table 3, no blister formation occurs in the slab having the nitrogen content within the range of this invention obtained under the sealing with argon gas from the ladle to the mold in the continuous casting.

Magnetic properties of the final products are shown in Table 4 hereinbelow:

Table 4

| | magnetic properties* | | |
|---|---|---|---|
| argon gas sealing | core loss $W_{15/50}$ | (W/kg) $W_{17/50}$ | Induction $B_8$ (Wb/m²) |
| yes | 0.842 | 1.265 | 1.845 |
| no | 0.844 | 1.268 | 1.843 |

*Magnetic properties in the table are the mean value of 12 measurements.

EXAMPLE 2

After tapping molten steel from a 100-ton converter to a ladle, degassing, deoxidation and alloy-addition treatment was carried out in a vacuum treatment apparatus. In the continuous casting of said molten steel, a first half of the casting, about 50 tons, was sealed with argon gas as an inventive example as in Example 1, and a latter half, about 50 tons, was cast for comparison without argon gas sealing. The analysis of the slab obtained was: C 0.042%, Si 3.22%, Mn 0.06%, P 0.012%, S 0.019%, Al 0.002% and H 1.2 ppm. Then, said slabs were hot rolled to an intermediate thickness, and treated by a usual two-stage cold rolling method to obtain a grain-oriented electrical strip with a thickness of 0.30 mm. The change of nitrogen content from the molten steel to the slab of said test materials and the occurrence of blisters in the final products were as shown in Table 5 hereinbelow:

Table 5

| nitrogen content ppm | | | sealing from ladle to mold | occurrence of blister in final product* |
|---|---|---|---|---|
| before tapping | in ladle | slab | | |
| | | 35 | argon sealing | % |
| 32 | 34 | 48 (comparison) | no | 7.8% |

*The degree of the occurrence of blisters in the table is expressed by the ratio of the length of blistered part to the total length of product.

As is obvious from Table 5 above, no blister formation occurs in the slab having the nitrogen content range of this invention obtained under the sealing with argon gas from the ladle to the mold in the continuous casting.

EXAMPLE 3

Two test materials, A and B, were smelted in a 100-ton converter. In tapping each of molten steel A and B, the deoxidation and alloy-addition treatment was carried out under the addition of the necessary amounts of Si and Al. In the continuous casting of each of molten steel A and B after a vacuum degassing treatment, a first half of the molten steel, about 50 tons, was sealed with argon gas from the ladle to the tandish and from the tandish to the mold, and a latter half of each of them, about 50 tons, was cast without argon gas sealing. The analyses of the slabs obtained were as shown in Table 6 hereinbelow:

Table 6

| steel | argon sealing | Composition of Slab composition (wt.%) | | | | | | | | |
|---|---|---|---|---|---|---|---|---|---|---|
| | | C | Si | Mn | P | S | Al | H | N | O |
| A | yes | 0.037 | 3.17 | 0.055 | 0.010 | 0.018 | 0.002 | 0.00014 | 0.0044 | 0.0052 |
| | no | 0.037 | 3.17 | 0.055 | 0.010 | 0.018 | 0.002 | 0.00014 | 0.0054 | 0.0054 |
| B | yes | 0.038 | 3.16 | 0.057 | 0.009 | 0.019 | 0.003 | 0.00015 | 0.0039 | 0.0087 |
| | no (comparison) | 0.038 | 3.16 | 0.057 | 0.009 | 0.019 | 0.003 | 0.00015 | 0.0055 | 0.0091 |

Said slabs were hot rolled to an intermediate thickness, and treated by a usual two-stage cold rolling method to obtain grain-oriented electrical strips with a thickness of 0.30 mm.

The occurrence of blisters in the final products were as shown in Table 7 hereinbelow:

Table 7

| steel | Rate of the occurrence of blister in final products | | | |
|---|---|---|---|---|
| | A | | B | |
| argon gas sealing | yes | no | yes | no |
| rate of the occurrence, of blister * | 0% | 3.2% | 0% | 5.9% |

Table 7-continued

*The degree of the occurrence of blister in the table is expressed by the ratio of the length of blistered part to the total length of products.

From Table 6 and Table 7, particularly by comparing argon gas sealed materials A and B, it is obvious that the occurrence of blister can be avoided by reducing the oxygen content, e.g., 52 ppm, even when the nitrogen content is relatively high, such as, 44 ppm.

The magnetic properties of the final products, treated similarly as in Example 1, are shown in Table 8 hereinbelow:

Table 8

| steel | Magnetic properties (after stress relieving annealing) | | | |
|---|---|---|---|---|
| | argon gas sealing | magnetic properties * core loss (W/kg) $W_{15/50}$ | $W_{17/50}$ | Induction $B_8$ (Wb/m²) |
| A | yes | 0.835 | 1.247 | 1.847 |
| | no | 0.838 | 1.250 | 1.846 |
| B | yes | 0.847 | 1.265 | 1.841 |
| | no | 0.852 | 1.272 | 1.838 |

* Magnetic properties in the table are the mean value of 12 measurements.

EXAMPLE 4

By a similar treatment as in Example 1, test materials C and D as shown in Table 9 (hereinbelow), having a relatively high Al content, were prepared. The occurrence of blister in the final products from these slabs were as shown in Table 10.

Table 9

| steel | argon sealing | Composition of slabs composition (wt.%) | | | | | | | | |
|---|---|---|---|---|---|---|---|---|---|---|
| | | C | Si | Mn | P | S | Al | H | N | O |
| C | yes | 0.042 | 3.13 | 0.053 | 0.005 | 0.019 | 0.025 | 0.00021 | 0.0068 | 0.0042 |
| | no | 0.042 | 3.13 | 0.053 | 0.005 | 0.019 | 0.023 | 0.00023 | 0.0079 | 0.0045 |
| D | yes | 0.041 | 3.18 | 0.058 | 0.006 | 0.016 | 0.028 | 0.00019 | 0.0062 | 0.0092 |
| | no | 0.041 | 3.18 | 0.058 | 0.006 | 0.016 | 0.026 | 0.00019 | 0.0080 | 0.0096 |

Table 10

| steel | Rate of the occurrence of blister in final products (thickness 0.3 mm) | | | |
|---|---|---|---|---|
| | A | | B | |
| argon gas sealing | yes | no | yes | no |
| rate of the occurrence | 0% | 4.3% | 0% | 7.4% |

Table 10-continued

| steel | Rate of the occurrence of blister in final products (thickness 0.3 mm) A | B |
|---|---|---|
| of blister | | |

Among these test materials, argon gas sealed samples C and D are within the scope of this invention. In sample C, $N<[Al(\%) \times 10^3 + 50]$ ppm and $0<80$ ppm, and sample D is an example of $N<[Al(\%) \times 10^3 + 40]$ ppm. There is no occurrence of blister in the final products from them. On the contrary, samples without argon gas sealing are without the scope of this invention, sample C being high in nitrogen content and sample D being high in nitrogen and oxygen contents, and blisters occurred in both samples.

The magnetic properties of the final products, treated similarly as in Example 1, are as shown in Table 11 hereinbelow:

Table 11

| steel | argon gas sealing | Magnetic properties (after stress relieving annealing) magnetic properties core loss (W/kg) $W_{15/50}$ | $W_{17/50}$ | Induction $B_8$ (Wb/m²) |
|---|---|---|---|---|
| C | yes | 0.836 | 1.249 | 1.854 |
| | no | 0.841 | 1.257 | 1.850 |
| D | yes | 0.367 | 1.295 | 1.843 |
| | no | 0.868 | 1.297 | 1.842 |

What is claimed is:

1. A continuously cast and vacuum degassed steel strip for use as a cube-on-edge oriented electrical steel sheet and strip which possesses no blister in the final product, obtained by the process which comprises heating a slab consisting essentially of 2.5 to 4.0 wt.% silicon, less than 0.40% aluminum, less than 3 ppm hydrogen and less than $[Al(\%) \times 10^3 + 40]$ ppm of nitrogen, with the balance being iron at a temperature not lower than about 1,200° C, and then hot rolling the slab, cold rolling the strip with a reduction not less than about 40%, subjecting the strip to decarburization annealing, and then final annealing the strip at a temperature not less than about 1,100° C.

2. The slab of claim 1 wherein the cold rolling is effected more than two times with an intermediate annealing step.

3. The grain oriented electrical steel sheet of claim 1 wherein said slab contains less than 0.01 wt.% of aluminium.

4. A continuously cast and vacuum degassed steel strip for use as a cube-on-edge oriented electrical steel sheet and strip which possesses no blister in the final product, obtained by the process which comprises heating a slab consisting essentially of 2.5 to 4.0 wt.% silicon, less than 0.04% aluminum, less than 3 ppm hydrogen, less than 80 ppm of oxygen and less than $[Al(\%) \times 10^3 + 50]$ ppm of nitrogen with the balance being iron at a temperature not lower than about 1,200° C, and then hot rolling the slab, cold rolling the strip with a reduction not less than about 40%, subjecting the strip to decarburization annealing, and then final annealing the strip at a temperature not less than about 1,100° C.

* * * * *

UNITED STATES PATENT OFFICE

CERTIFICATE OF CORRECTION

Patent No. 4006044 Dated February 1, 1977

Inventor(s) Tatsuo Oya et al

It is certified that error appears in the above-identified patent and that said Letters Patent are hereby corrected as shown below:

In the heading of the Patent, the following should be added:

--[30] Foreign Application Priority Data
May 20, 1971 Japan..... 46-34254
October 20, 1972 Japan..... 46-83155--.

Signed and Sealed this

Twelfth Day of April 1977

[SEAL]

*Attest:*

RUTH C. MASON
*Attesting Officer*

C. MARSHALL DANN
*Commissioner of Patents and Trademarks*